United States Patent [19]

Dietrich et al.

[11] Patent Number: 4,653,407

[45] Date of Patent: Mar. 31, 1987

[54] TWO-RAIL TROLLEY

[75] Inventors: Udo Dietrich, Gevelsberg; Heinz Hasselmann, Hagen-Emst, both of Fed. Rep. of Germany

[73] Assignee: Mannesmann AG, Duesseldorf, Fed. Rep. of Germany

[21] Appl. No.: 700,405

[22] Filed: Feb. 11, 1985

[30] Foreign Application Priority Data

Feb. 11, 1984 [DE] Fed. Rep. of Germany ..... 3404867

[51] Int. Cl.[4] ..... B61B 3/02

[52] U.S. Cl. ..... 105/148; 104/94

[58] Field of Search ..... 104/89, 94, 95, 90, 104/91, 122; 105/148, 154, 155, 98, 106, 107; 212/205, 213, 215, 217, 214, 216

[56] References Cited

U.S. PATENT DOCUMENTS

| | | | |
|---|---|---|---|
| 965,490 | 7/1910 | Stewart | 301/114 |
| 2,063,911 | 12/1936 | Fitch | 212/205 |
| 2,265,385 | 12/1941 | Martin | 105/150 |
| 2,884,871 | 5/1959 | Mazzola et al. | 105/148 |

FOREIGN PATENT DOCUMENTS

| | | | |
|---|---|---|---|
| 684939 | 1/1967 | Belgium | 212/217 |
| 688413 | 10/1979 | U.S.S.R. | 105/148 |
| 747758 | 7/1980 | U.S.S.R. | 105/148 |

*Primary Examiner*—Robert B. Reeves
*Assistant Examiner*—Dennis Rodgers
*Attorney, Agent, or Firm*—Ralf H. Siegemund

[57] ABSTRACT

A lifting device having front plates at the end of the winch drum the front plates being provided with flanges to which bracket elements are secured. The bracket elements are interconnected by means of tension rods as well as carriers for the wheels to obtain a rectangular configuration.

8 Claims, 7 Drawing Figures

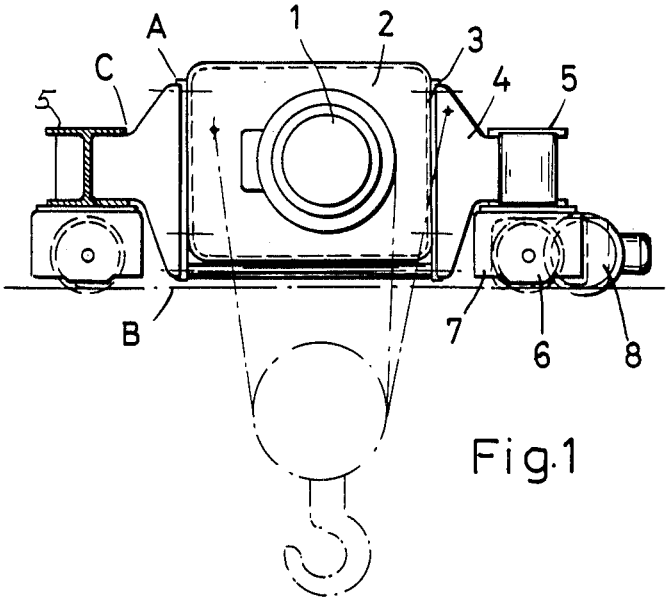
Fig.1
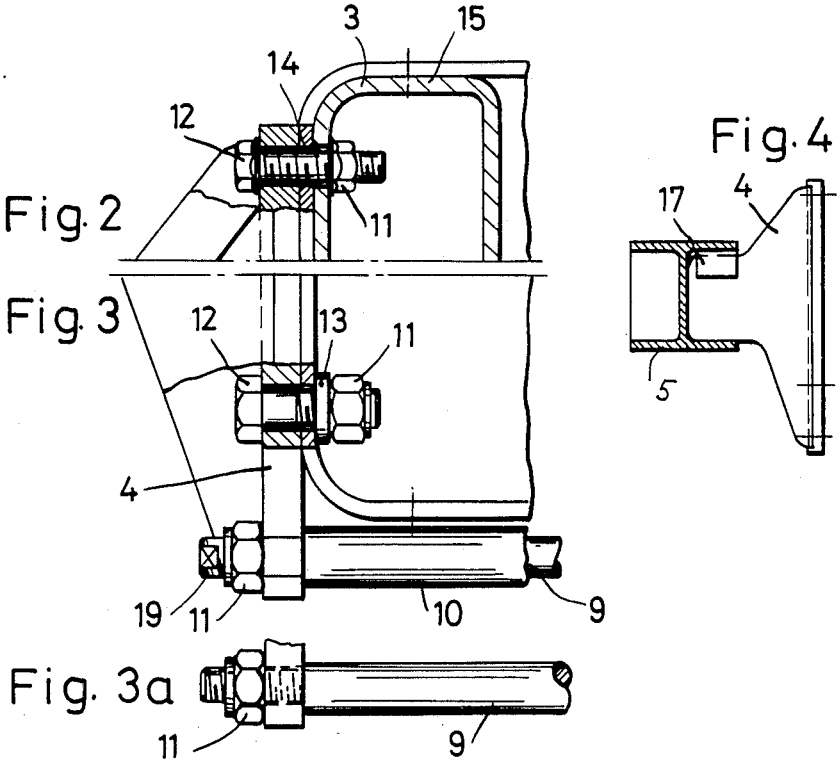
Fig. 2
Fig. 3
Fig. 3a
Fig. 4

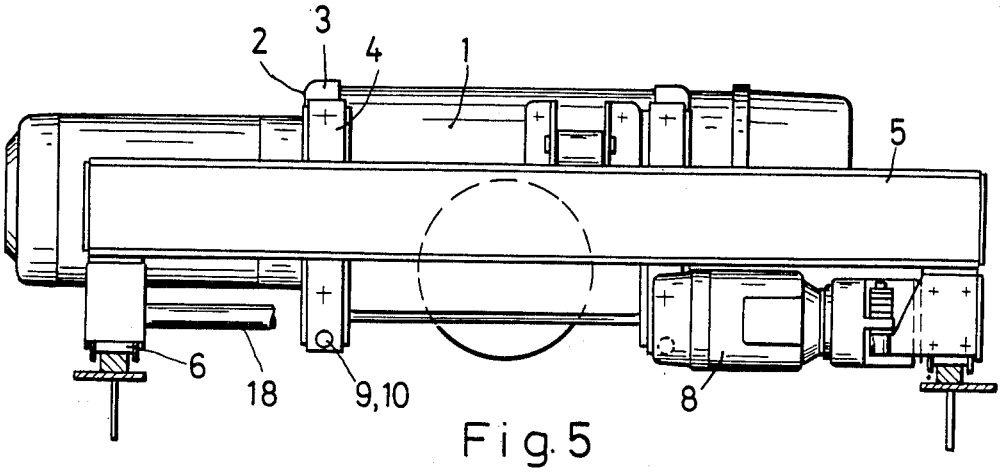
Fig. 5
Fig. 6
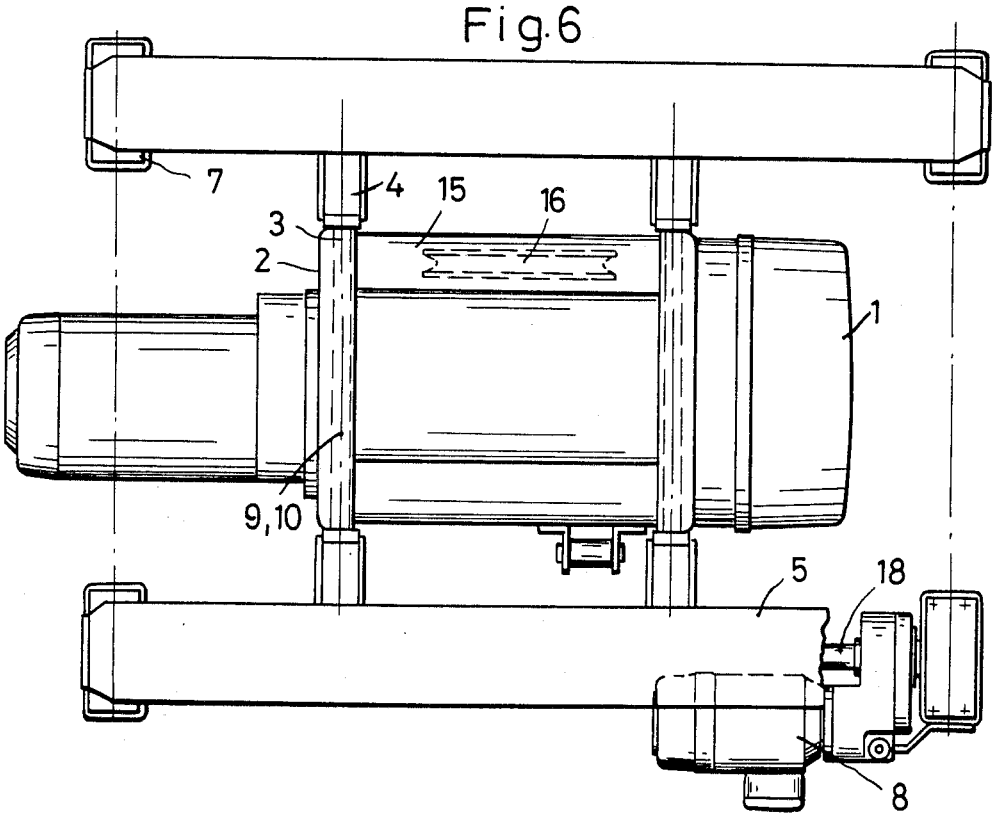

TWO-RAIL TROLLEY

BACKGROUND OF THE INVENTION

The present invention relates to a two-rail trolley with lifting equipment including a frame for mounting the wheels.

Known two-rail trolleys are for example disclosed in German Petty Patent No. 1,855,853. Herein a frame is provided for mounting lifting equipment in such the manner that the trolley from an overall point of view becomes unnecessarily high. Also it is believed that the construction of the frame is needlessly complicated and expensive.

DESCRIPTION OF THE INVENTION

It is an object of the present invention to provide a new and improved two-rail trolley of low height and of simple construction.

In accordance with the preferred embodiment of the present invention it is suggested to establish a frame under utilization of two front plates which receive the lifting equipment and that bracket elements are connected to lateral flanges being bent off plates extending sideways from the front plates and that the wheels are connected directly or indirectly to these bracket elements. Moreover, bracket elements arranged so as to be situated in relation to each other along the direction of movement are interconnected by means of tension bars running under the lifting equipment. It can thus be seen that the tension rods, the flanges and the bracket elements really replace the conventional overall frame structure for a two-rail trolley and it is through these construction features that a very low height is attained.

Basically the height i.e., the vertical dimension of the trolley is determined by the front plates which receive the lifting equipment as well as by the tension rods underneath and which run between the bracket elements on the same side of the trolley, and by the utilization of spacer sleeves such that the front plates of the lifting equipment upon tensioning of the rods will not experience any pressure or compression forces. The tension rods may alternatively be provided as rods which penetrate the brackets and are provided with welded-on threads.

Each bracket element is preferably centered by means of a clamping sleeve right at the transition zone to the respective front plate. Drilling is supposed to be avoided which is achieved here by running the screw for fastening the brackets to the respective flange through the respective clamping sleeve.

In furtherance of the invention, the flanges of the front plates are directed towards each other in pairs and interconnected by means of supports extending in the direction across the tracks and transversely to the direction of movement of the trolley. Moreover, two brackets arranged analogously, as seen in the direction of travel, may be interconnected through carriers for carrying the wheels whereby the carriers receiving the ends of the brackets are not as high as the spacing between the flanges. The remaining free space permits orienting of the carriers facing each other and is bridged through welded on flanges which abut laterally the brackets and are shifted towards the flanges of the front plates.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompnaying drawings in which:

FIG. 1 is a side view of a two-rail trolley constructed in accordance with the preferred embodiment of the present invention for practicing the best mode thereof;

FIG. 2 illustrates a detail as indicated by A in FIG. 1 but on an enlarged scale;

FIG. 3 illustrates a detail as indicated by B in FIG. 1 but showing the detail on a larger scale;

FIG. 3*a* is a modification for the tension rod construction;

FIG. 4 illustrates in an enlarged scale the detail C of FIG. 1;

FIG. 5 is a front view of the trolley shown in FIG. 1; and

FIG. 6 is a top view of the trolley shown in FIGS. 1 and 5.

Proceding now to the detailed description of the drawings, the figures show as the basic element to be moved and transported (that is the purpose of the trolley) a lifting equipment or device 1 with a winch. This lifting equipment has front plates 2. The front plates 2 in turn are provided in each instance with flanges 3 to which are affixed bracket elements 4 under utilization of bolts 12.

Bracket elements 4 facing each other in the direction of the trolley equipment, and therefor the respective flanges 3 are interconnected by means of tension rods 9 which run through spacer sleeves 10 particularly covering that space between the respective two brackets 4. The tension rods 9 are bolted to the bracket elements 4 by means of nuts 11. As shown specifically in FIG. 3*a* this being a slightly modified construction for the tension rods, the spacer sleeves being omitted here, but the rods 9 have welded on threads penetrating the respective bracket elements. The tension rods have shoulders abutting the respective bracket element from one side, the nut 11 bears aganist the other side.

In either case there are upper screws or bolts 12 as stated for fastening the brackets 4 to the flanges 3 and these bolts are run through clamping sleeves 13 which in turn run through the flanges 3 and the brackets 4, they in fact extend to a support 15 which in turn interconnects the flanges 3 of the front plates 2 of the lifting device 1. There are two such supports 15 and they extend transversely to the direction of trolley movement. Tension rods 9, carriers 5 and elements 4 and 3 establlish a rectangular array. Moreover as shown in FIGS. 5 and 6 the bracket elements 4 are additionally interconnected by means of the carrier elements 5 being of I-beam configuration carrying at their ends journals and wheel bearing mounts 7 for the wheels 6. A drive 8 is secured to one of the wheel journals. The drive moreover has a transmission connected to the two oppositely positioned wheels 6 via a shaft 18. FIG. 6 moreover shows a cable pully 16 being situated underneath the support 15.

As one can see from FIG. 4 the brackets 4 each have a tapering end which reaches into and extends into the I-beam 5. Through welding flange 17 the tapered end of a bracket element is welded to the upper portion of the I-beam 5 but the taper abuts directly with and sits on the lower portion of carrier 5. The tension rod 9 is secured against rotation in that the tension rod has square shaped ends. Upon tensioning of the nut against the square end it will be secured against rotation.

The invention is not limited to the embodiments described above but all changes and modifications therof not constituting departures from the spirit and scope of the invention are intended to be included.

We claim:

1. Two-rail trolley with a lifting device, said trolley having wheels and further comprising:

two front plates, there being lateral flanges extending in bent off configuration from said front plates, the lifting device being arranged on the trolley between these plates;

bracket elements for support of said front plates and said lifting device and being secured to said lateral flanges;

respective two of the bracket elements being arranged spaced apart as seen in a direction across a track direction i.e., transversely to the direction of movement;

two bracket elements as so arranged, being connected to a carrier also extending transversely to the direction of movement, there being two such carriers respectively arranged on opposite sides of said lifting device; and tension rods interconnecting respective two of the bracket elements being positioned one behind the other in the direction of track extension and trolley movement.

2. Trolley as in claim 1 wherein said tension rods are received by spacer sleeves extending between the respective bracket elements.

3. Trolley as in claim 1 wherein the tension rods have shoulders bearing against the bracket elements, said rods having end threading, there being nuts threaded on the threaded ends for tightening the rods against the respective bracket element.

4. Trolley as in claim 1 and including at least one clamping sleeve for centering the bracket element to the respective flange.

5. Trolley as in claim 4 wherein a bolt traverses the clamping sleeve.

6. Trolley as in claim 1 said flanges of said front plates being oriented in relation to each other in a direction transverse to the direction of trolley movement and being interconnected by means of supports extending in said transverse direction.

7. Trolley as in claim 1 said wheels being journaled to said carriers.

8. Trolley as in claim 7 wherein ends of said bracket elements extend into the carrier, said ends are not as high as a spacing between flanges of the carrier, further including welding connections being provided between the flanges and the bracket elements.

* * * * *